US009979162B2

(12) United States Patent
Kasahara et al.

(10) Patent No.: US 9,979,162 B2
(45) Date of Patent: May 22, 2018

(54) PLASMA JET PLUG

(71) Applicant: NGK Spark Plug Co., LTD., Nagoya (JP)

(72) Inventors: Daisuke Kasahara, Anjo (JP); Yuichi Yamada, Niwa-gun (JP); Naoyuki Mukoyama, Nisshin (JP)

(73) Assignee: NGK SPARK PLUG CO., LTD., Nagoya (JP)

( * ) Notice: Subject to any disclaimer, the term of this patent is extended or adjusted under 35 U.S.C. 154(b) by 0 days. days.

(21) Appl. No.: 15/492,242

(22) Filed: Apr. 20, 2017

(65) Prior Publication Data

US 2017/0358905 A1 Dec. 14, 2017

(30) Foreign Application Priority Data

Jun. 8, 2016 (JP) ..... 2016-114050

(51) Int. Cl.

| | |
|---|---|
| ***H01T 13/54*** | (2006.01) |
| ***H01T 13/04*** | (2006.01) |
| ***H01T 13/32*** | (2006.01) |
| ***H01T 21/02*** | (2006.01) |
| ***H01T 13/16*** | (2006.01) |

(52) U.S. Cl.

CPC ..... *H01T 13/54* (2013.01); *H01T 13/04* (2013.01); *H01T 13/16* (2013.01); *H01T 13/32* (2013.01); *H01T 21/02* (2013.01)

(58) Field of Classification Search

USPC ..... 123/169 EL

See application file for complete search history.

(56) References Cited

U.S. PATENT DOCUMENTS 2,616,406 A * 11/1952 Thomas ..... H01T 13/24 174/152 S 2,863,080 A 12/1958 Bychinsky et al.

FOREIGN PATENT DOCUMENTS

JP 56-38988 U 4/1981

JP 2008-45449 A 2/2008

OTHER PUBLICATIONS

Office Action dated Mar. 20, 2018 for the corresponding Japanese Patent Application No. 2016-114050.

* cited by examiner

*Primary Examiner* — Ashok Patel

(74) *Attorney, Agent, or Firm* — Leason Ellis LLP

(57) ABSTRACT

A plasma jet plug includes a rod-shaped central electrode, an insulator having an axial hole, a metal shell disposed around the insulator, an orifice electrode electrically connected to the metal shell and located at a distal end side of the insulator, and a gasket that contacts an outer surface of the insulator and an inner surface of the metal shell. The insulator includes a first member, a second member and an inorganic seal layer. The first member has the axial hole and includes a large-diameter portion and a small-diameter portion. The second member has a through hole into which the small-diameter portion is inserted. The second member has an outer surface that contacts the gasket. The inorganic seal layer seals a gap between the first member and the second member. In a section including the axis, the sum of seal lengths is greater than or equal to 3 mm.

3 Claims, 6 Drawing Sheets

PLASMA JET PLUG

This application claims the benefit of Japanese Patent Application No. 2016-114050, filed Jun. 8, 2016, which is incorporated by reference herein in its entirety.

BACKGROUND OF THE INVENTION

1. Field of the Invention

The present application relates to a plasma jet plug for igniting fuel gas in a device such as an internal combustion engine.

2. Description of the Related Art

Plasma jet plugs are known as a type of ignition plugs for igniting fuel gas in an internal combustion engine (see, for example, Japanese Unexamined Patent Application Publication No. 2008-45449). A plasma jet plug has an insulator made of a material such as ceramics, which encloses a discharge space (also referred to as a cavity), and a central electrode and a ground electrode, which define a spark gap inside the discharge space. When a plasma jet plug causes (discharges) a spark in the spark gap, gas inside the cavity is excited to form plasma in the cavity. When the plasma formed in the cavity is ejected out of the cavity, fuel gas is ignited. Compared to a spark plug that directly ignites fuel gas by a spark discharge, a plasma jet plug is advantageous in that it allows combustion to spread faster and it can reliably ignite a lean fuel mixture having a high air-fuel ratio.

SUMMARY OF THE INVENTION

A plasma jet plug, however, is disadvantageous in that it fails to satisfy both the ignition performance and the durability. When, for example, a plasma jet plug has a relatively large cavity, it is more likely to have low ignition performance since only a small amount of plasma formed in the cavity is likely to be ejected to the outside. When, on the other hand, a plasma jet plug has a relatively small cavity, it is more likely to have low durability since the insulator that defines the cavity is more likely to be damaged by a surface discharge, in which a spark is caused along the insulator.

The description discloses a technology for satisfying both the ignition performance and the durability of a plasma jet plug.

The technology disclosed in the description is provided to at least partially solve the above-described problem and is capable of being embodied in application examples described below.

APPLICATION EXAMPLE 1

A plasma jet plug includes a rod-shaped central electrode extending in a direction of an axis, a tube-shaped insulator extending in the direction of the axis and having an axial hole in a distal portion of which the central electrode is disposed, a metal shell disposed on an outer periphery of the insulator, an orifice electrode electrically connected to the metal shell and located at a distal end side of the insulator, and a gasket that is in contact with an outer surface of the insulator and an inner surface of the metal shell. The insulator includes a first member, a second member, and an inorganic seal layer. The first member has the axial hole and includes a large-diameter portion and a small-diameter portion having a smaller outer diameter than the large-diameter portion. The small-diameter portion is located at a distal end side of the large-diameter portion. The second member extends in the direction of the axis and has a through hole into a proximal portion of which the small-diameter portion is inserted. The second member has an outer surface that is in contact with the gasket. The inorganic seal layer seals a gap between the first member and the second member. The gap includes a space between an outer circumferential surface of the small-diameter portion and an inner circumferential surface of the through hole. A distal portion of the first member, a distal portion of the second member, a surface of the central electrode, and an inner surface of the orifice electrode define a cavity. In a section including the axis, the sum of seal lengths of portions of the gap between the first member and the second member, which are sealed by the inorganic seal layer and have a distance of smaller than or equal to 0.2 mm, is greater than or equal to 3 mm.

In the above-described configuration, a distal portion of the first member, a distal portion of the second member, a surface of the central electrode, and an inner surface of the orifice electrode define a cavity. Thus, the surfaces of the insulator that define the cavity can have a complex shape. This complex shape can thus extend a path along which a spark is discharged (surface path, below) over the surface of the insulator without excessively increasing the capacity of the cavity. This configuration can thus prevent an occurrence of a surface discharge without reducing the amount of plasma ejected, so that the plasma jet plug can satisfy both the durability and the ignition performance. The second member is in contact with the metal shell with the gasket interposed therebetween and a gap between the first member and the second member is sealed by the inorganic seal layer. The sum of the seal lengths of portions of the gap, which are sealed by the inorganic seal layer and have a distance of smaller than or equal to 0.2 mm, is greater than or equal to 3 mm. This configuration can thus prevent a high-temperature combustion gas from intruding into the gap between the first member and the second member and transfer the heat of the first member to the metal shell through the inorganic seal layer, the second member, and the gasket. This configuration can thus improve the heat conductivity of the insulator and prevent an occurrence of pre-ignition.

APPLICATION EXAMPLE 2

In the plasma jet plug according to Application Example 1, a position of the gasket in the direction of the axis is located within a range of a threaded area of an outer surface of the metal shell in the direction of the axis.

This configuration can further improve the heat conductivity of the insulator.

APPLICATION EXAMPLE 3

In the plasma jet plug according to Application Example 1 or 2, the inorganic seal layer contains glass having a melting point of higher than or equal to 1,200 degrees Celsius and a softening point of higher than or equal to 900 degrees Celsius.

In the above-described configuration, the joint between the first member and the second member is prevented from becoming loose.

APPLICATION EXAMPLE 4

Application Example 4 is a method for manufacturing a plasma jet plug including a rod-shaped central electrode extending in a direction of an axis, a tube-shaped insulator extending in the direction of the axis and having an axial hole in a distal portion of which the central electrode is disposed, a metal shell disposed on an outer periphery of the insulator, an orifice electrode electrically connected to the metal shell and located at a distal end of the insulator, and a gasket that is in contact with an outer surface of the insulator and an inner surface of the metal shell. The insulator includes a first member and a second member. The first member has the axial hole and includes a large-diameter portion and a small-diameter portion having a smaller outer diameter than the large-diameter portion. The small-diameter portion is located at a distal end of the large-diameter portion. The second member extends in the direction of the axis and has a through hole into a proximal portion of which the small-diameter portion is inserted. The second member has an outer surface that is in contact with the gasket. A distal portion of the first member, a distal portion of the second member, a surface of the central electrode, and an inner surface of the orifice electrode define a cavity. The method includes the following steps (a), (b), and (c): (a) a step of applying slurry containing an inorganic powder material to either one or both of a surface of the first member including an outer circumferential surface of the small-diameter portion and a surface of the second member including an inner circumferential surface defining the through hole, (b) a step of inserting the small-diameter portion of the first member into the through hole of the second member to form the insulator, and (c) a step of sintering the powder material as a result of heating the insulator to a temperature within a range of 1,250 degrees Celsius to 1,350 degrees Celsius to form an inorganic seal layer that seals a gap between the first member and the second member, the gap including a space between the outer circumferential surface of the small-diameter portion and the inner circumferential surface defining the through hole. In a section including the axis, the inorganic seal layer is formed such that the sum of seal lengths of portions of the gap between the first member and the second member, which are sealed by the inorganic seal layer and have a distance of smaller than or equal to 0.2 mm, is greater than or equal to 3 mm.

This method can manufacture a plasma jet plug including an insulator including an inorganic seal layer that appropriately seals a gap between the first member and the second member.

The technology disclosed in the description can be embodied in various different forms including, for example, a plasma jet plug, an ignition system including the plasma jet plug, an internal combustion engine including the plasma jet plug, an internal combustion engine including an ignition system including the plasma jet plug, and a method for manufacturing an insulator for the plasma jet plug.

BRIEF DESCRIPTION OF THE DRAWINGS

These and other features and advantages of the present invention will become more readily appreciated when considered in connection with the following detailed description and appended drawings, wherein like designations denote like elements in the various views, and wherein.

DETAILED DESCRIPTION OF THE INVENTION

A. Embodiment

A-1. Entire Configuration of Plasma Jet Plug

Figure 1:
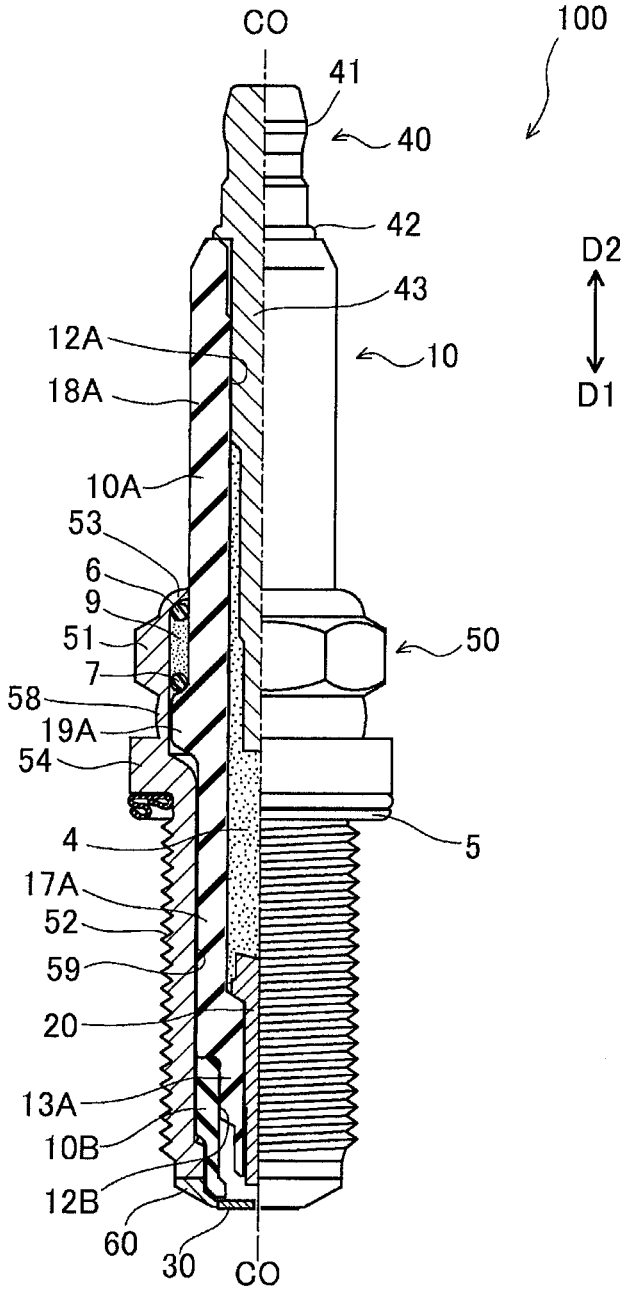
FIG. 1 illustrates the entirety of a plasma jet plug 100 according to an embodiment.
Figure 2:
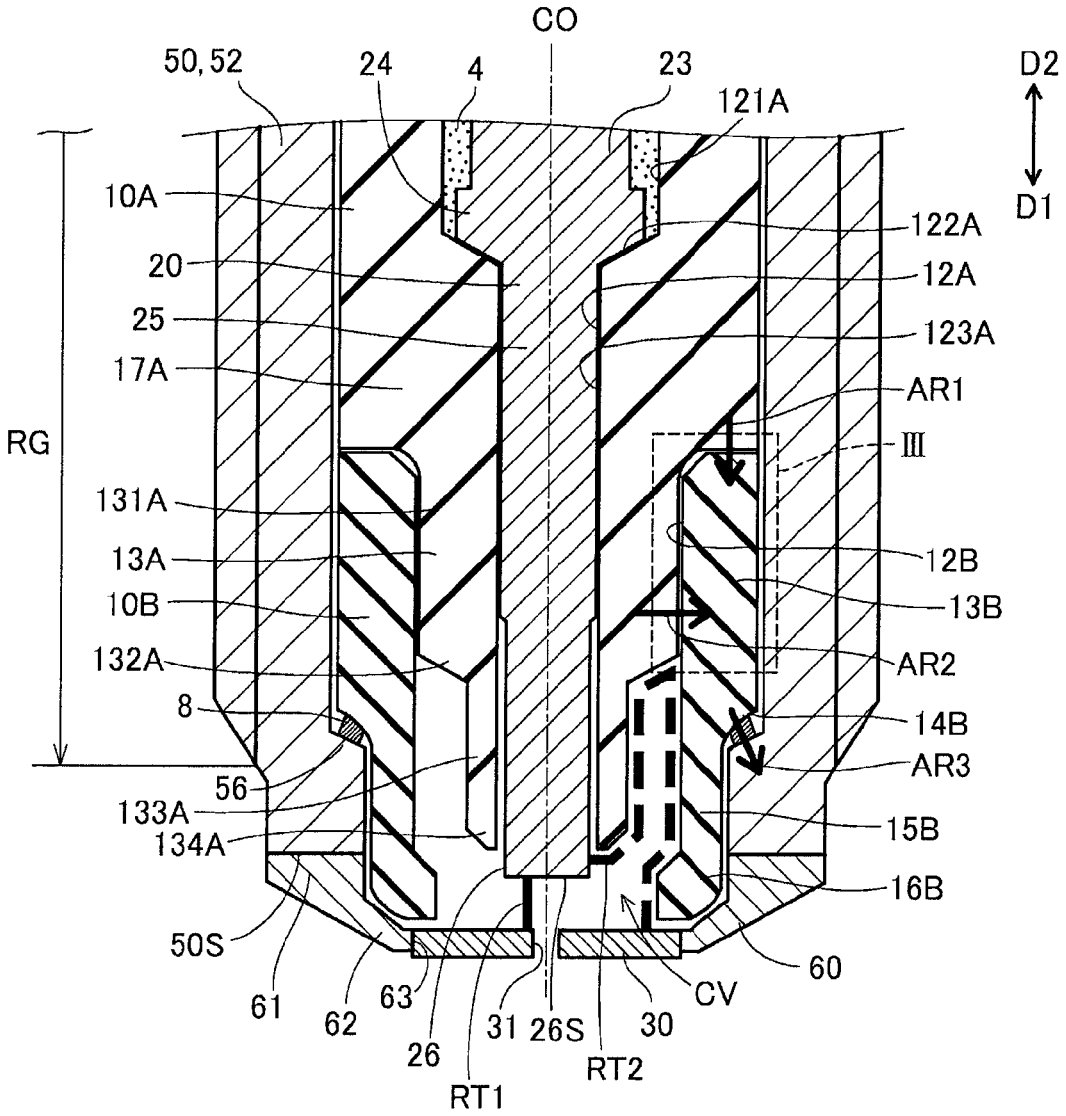
FIG. 2 is a sectional view of the plasma jet plug 100 at a portion near a central electrode 20.

An embodiment of the present invention is described below. FIG. 1 illustrates the entirety of a plasma jet plug 100 according to an embodiment. The appearance of the plasma jet plug 100 is illustrated on the right side of an axial line CO in FIG. 1 and a section taken in plane including the axial line CO is illustrated on the left side of the axial line CO. FIG. 2 is a sectional view of the plasma jet plug 100 at a portion around a central electrode 20. The direction parallel to the axial line CO (vertical direction in FIG. 1 and FIG. 2) is also referred to as an axial direction. A direction of the radius of a circle having the axial line CO at the center is also simply referred to as a "radial direction" and a direction of the circumference of a circle having the axial line CO at the center is also simply referred to as a "circumferential direction". A direction toward the bottom in FIG. 1 and FIG. 2 is also referred to as a distal direction D1 and a direction toward the top in FIG. 1 and FIG. 2 is also referred to as a proximal direction D2. The bottom side in FIG. 1 and FIG. 2 is referred to as a distal side of the plasma jet plug 100 and the top side in FIG. 1 and FIG. 2 is referred to as a proximal side of the plasma jet plug 100.

The plasma jet plug 100 includes an insulator 10, a central electrode 20, a ground electrode 30, a metal terminal 40, a metal shell 50, and a cap member 60 (FIG. 1).

The insulator 10 is a substantially cylindrical-tube-shaped member extending in the axial direction and having an axial hole 12A extending through the insulator 10. The insulator 10 includes two members, that is, a first member 10A and a second member 10B. The first member 10A and the second member 10B are formed by firing a material such as alumina.

The first member 10A is a substantially cylindrical-tube-shaped member forming a large part of the insulator 10. The axial hole 12A is formed in the first member 10A. The first member 10A includes a flange portion 19A, a proximal trunk portion 18A, a distal trunk portion 17A, and a long leg portion 13A. The proximal trunk portion 18A is located at the proximal end side of the flange portion 19A. The proximal trunk portion 18A has an outer diameter smaller than that of the flange portion 19A. The distal trunk portion 17A is located at the distal end side of the flange portion 19A. The distal trunk portion 17A has an outer diameter smaller than that of the proximal trunk portion 18A. The long leg portion 13A is located at the distal end side of the distal trunk portion 17A. The long leg portion 13A has an outer diameter smaller than that of the distal trunk portion 17A. Since the outer diameter of the distal trunk portion 17A is larger than the outer diameter of the long leg portion 13A, the distal trunk portion 17A is also referred to as a "large-diameter portion" of the first member 10A and the long leg portion 13A is also referred to as a "small-diameter portion" of the first member 10A.

The second member 10B is a substantially cylindrical-tube-shaped member extending in the axial direction and having a through hole 12B that extends through the second member 10B. The length of the second member 10B in the axial direction is shorter than that of the first member 10A and slightly longer than that of the long leg portion 13A of the first member 10A. The long leg portion 13A (small-diameter portion) of the first member 10A is inserted into a proximal portion of the through hole 12B of the second member 10B. The details of the configuration of the first member 10A and the second member 10B are described below.

The metal shell 50 is a substantially cylindrical-tube-shaped member (tube member) made of an electrically conductive metal material, such as low-carbon steel. The metal shell 50 is used for fixing the plasma jet plug 100 to an engine head (not illustrated) of an internal combustion engine. The metal shell 50 has an insertion hole 59 that extends through the metal shell 50 along the axial line CO. The metal shell 50 is disposed around the insulator 10. In other words, the insertion hole 59 houses the entirety of the second member 10B, a distal portion of the proximal trunk portion 18A, the flange portion 19A, the distal trunk portion 17A, and the long leg portion 13A of the first member 10A.

The metal shell 50 includes a tool fastening portion 51, having a hexagonal prism shape and on which a spark plug wrench is engaged, a threaded portion 52, used for attaching the metal shell 50 to the internal combustion engine, and a flange-shaped seat portion 54, disposed between the tool fastening portion 51 and the threaded portion 52 (FIG. 1). The nominal diameter of the threaded portion 52 is, for example, M8 (8 millimeters or 8 mm), M10, M12, M14, or M18.

An annular gasket 5, formed by bending a metal plate, is fitted to a portion between the threaded portion 52 and the seat portion 54 of the metal shell 50 (FIG. 1). The gasket 5 seals a gap between the plasma jet plug 100 and an internal combustion engine (engine head) when the plasma jet plug 100 is attached to the internal combustion engine.

The metal shell 50 also includes a thin crimped portion 53, disposed on the proximal end of the tool fastening portion 51, and a thin compressed-deformed portion 58, disposed between the seat portion 54 and the tool fastening portion 51 (FIG. 1). Annular line gaskets 6 and 7 are disposed in an annular region defined by an inner circumferential surface of a portion of the metal shell 50 extending from the tool fastening portion 51 to the crimped portion 53 and an outer circumferential surface of the proximal trunk portion 18A of the first member 10A. The space between the two line gaskets 6 and 7 in the annular region is filled with powder of talc 9. A portion of the insertion hole 59 of the metal shell 50 near the distal end of the threaded portion 52 tapers from the proximal side toward the distal side. Thus, the insertion hole 59 has a step-shaped lock portion 56 on the inner circumferential surface of the insertion hole 59 (FIG. 2).

A proximal portion of the crimped portion 53 is bent radially inward and fixed to the outer circumferential surface of the insulator 10 (first member 10A). The compressed-deformed portion 58 of the metal shell 50 is compressed and deformed as a result of the crimped portion 53 fixed to the outer circumferential surface of the insulator 10 (first member 10A) being pressed toward the distal end during manufacture. Due to the compression and deformation of the compressed-deformed portion 58, the insulator 10 (first member 10A and second member 10B) is pressed toward the distal end inside the metal shell 50 with the line gaskets 6 and 7 and the talc 9 interposed therebetween. Thus, the insulator 10 (second intermediate tapered-diameter portion 14B of second member 10B, described below (FIG. 2)) is pressed against the lock portion 56 on the inner circumferential surface of the metal shell 50 with an annular plate gasket 8 (FIG. 2) made of metal interposed therebetween. The plate gasket 8 is thus in contact with the outer circumferential surface of the insulator 10 (outer circumferential surface of second member 10B) and the inner circumferential surface of the metal shell 50 (inner circumferential surface defining the lock portion 56). The space between the insulator 10 and the lock portion 56 of the metal shell 50 is thus sealed as a result of the plate gasket 8 being interposed therebetween. Gas inside the combustion chamber of an internal combustion engine is thus prevented from leaking out through the gap between the metal shell 50 and the insulator 10. The annular plate gasket 8 made of metal has higher thermal conductivity than the insulator 10 or the inorganic seal layer 70. Thus, the annular plate gasket 8 has a function of releasing the heat of the insulator 10 to the metal shell 50, as described below.

The central electrode 20 is a rod-shaped member extending along the axial line CO and disposed at a distal portion of the axial hole 12A of the first member 10A. The central electrode 20 is made of a metal material having electric conductivity and high oxidation resistance under a high temperature, for example, nickel (Ni) or an alloy mainly composed of Ni (specifically, NCF600 or NCF601). The central electrode 20 may also include a core member disposed inside and made of a metal having higher thermal conductivity than Ni or an alloy mainly composed of Ni, such as copper or an alloy mainly composed of copper.

The cap member 60 is joined to the distal end of the metal shell 50. The ground electrode 30 is attached to the cap member 60. The cap member 60 and the ground electrode 30 are each made of a metal material having electric conductivity and high oxidation resistance under a high temperature. For example, the cap member 60 is made of nickel (Ni) or an alloy mainly composed of Ni (specifically, NCF600 or NCF601). The ground electrode 30 is made of a material such as iridium (Ir), platinum (Pt), tungsten (W), or an alloy mainly composed of Ir, Pt, and/or W. The configuration of a distal portion of the plasma jet plug 100 including the central electrode 20, the cap member 60, and the ground electrode 30 is described in detail below.

The metal terminal 40 is a rod-shaped member extending along the axial line CO. The metal terminal 40 is made of an electrically conductive metal material, such as low-carbon steel, and has its surface covered with an anti-corrosive metal layer (such as Ni layer) by, for example, plating. The metal terminal 40 includes a flange portion 42, located at a predetermined position in the axial direction, a cap-receiving portion 41, located at the proximal end of side of the flange portion 42, and a leg portion 43, located at the distal end side of the flange portion 42. The cap-receiving portion 41 including the proximal end of the metal terminal 40 is exposed to the outside at a proximal portion of the insulator 10. The leg portion 43 including the distal end of the metal terminal 40 is inserted into the axial hole 12A of the first member 10A. A plug cap to which a high-voltage cable (not illustrated) is to be connected is attached to the cap-receiving portion 41 and a high voltage is applied for causing a spark.

A space inside the axial hole 12A of the first member 10A between the distal end of the leg portion 43 of the metal terminal 40 and the proximal end of the central electrode 20 is filled with an electrically conductive seal 4. Thus, the metal terminal 40 and the central electrode 20 are electrically continuous with each other. The electrically conductive seal 4 is made of, for example, a composite containing metal particles and glass particles.

A-2. Configuration of Distal Portion of Plasma Jet Plug 100

The configuration of the distal portion of the above-described plasma jet plug 100 is further described in detail. FIG. 2 is a sectional view of the distal portion of the plasma jet plug 100, taken in plane including the axial line CO.

The axial hole 12A includes a large diameter hole 121A, disposed at a proximal portion, a small diameter hole 123A, disposed at a distal portion, and a tapered-diameter hole 122A, disposed between the large diameter hole 121A and the small diameter hole 123A and tapering from the proximal side toward the distal side.

The central electrode 20 includes a head portion 23, a flange portion 24, a leg portion 25, and a discharge portion 26. The flange portion 24 is located at the distal end side of the head portion 23 and has a larger outer diameter than the head portion 23. The leg portion 25 is located at the distal end side of the flange portion 24. The outer diameter of the leg portion 25 is smaller than that of the flange portion 24 and substantially equal to the diameter of the small diameter hole 123A. The discharge portion 26 is located at the distal end side of the leg portion 25 and has a smaller outer diameter than the leg portion 25. The distal surface of the discharge portion 26 serves as a discharge surface 26S that defines a spark gap together with the ground electrode 30. The distal surface of the flange portion 24 is supported by the inner circumferential surface (tapered-diameter surface) that defines the tapered-diameter hole 122A of the first member 10A. Proximal portions of the head portion 23 and the flange portion 24 are supported by the electrically conductive seal 4. Thus, the central electrode 20 is held in the axial hole 12A of the first member 10A such that the leg portion 25 and the discharge portion 26 are located inside the small diameter hole 123A.

The long leg portion 13A is the distal most portion of the first member 10A. The long leg portion 13A has the above-described small diameter hole 123A on the inner side. The long leg portion 13A includes a first proximal uniform-diameter portion 131A, a first distal uniform-diameter portion 133A located at the distal end side of the first proximal uniform-diameter portion 131A, a first intermediate tapered-diameter portion 132A located between the first proximal uniform-diameter portion 131A and the first distal uniform-diameter portion 133A, and a first distal tapered-diameter portion 134A located at the distal end side of the first distal uniform-diameter portion 133A. The outer diameter of the first proximal uniform-diameter portion 131A is larger than the outer diameter of the first distal uniform-diameter portion 133A. The outer diameter of the first intermediate tapered-diameter portion 132A and the outer diameter of the first distal tapered-diameter portion 134A taper from the proximal side toward the distal side. The distal end of the first member 10A (distal end of first distal tapered-diameter portion 134A) is located at the proximal end side of the distal surface 50S of the metal shell 50 and the discharge surface 26S.

The above-described through hole 12B is formed in the second member 10B. As described above, the long leg portion 13A of the first member 10A is inserted into the through hole 12B. The second member 10B includes a second proximal uniform-diameter portion 13B, a second distal uniform-diameter portion 15B located at the distal end side of the second proximal uniform-diameter portion 13B, a second intermediate tapered-diameter portion 14B located between the second proximal uniform-diameter portion 13B and the second distal uniform-diameter portion 15B, and a second distal tapered-diameter portion 16B located at the distal end side of the second distal uniform-diameter portion 15B. The outer diameter of the second proximal uniform-diameter portion 13B is larger than the outer diameter of the second distal uniform-diameter portion 15B. The outer diameter of the second intermediate tapered-diameter portion 14B and the outer diameter of the second distal tapered-diameter portion 16B taper from the proximal side toward the distal side. In the second distal tapered-diameter portion 16B, the through hole 12B also tapers from the proximal side.

The distal end of the second member 10B (distal end of second distal tapered-diameter portion 16B) is located at the distal end side of the distal surface 50S of the metal shell 50 and the discharge surface 26S.

The above-described step-shaped lock portion 56 of the metal shell 50 is located near the second intermediate tapered-diameter portion 14B of the second member 10B. The outer circumferential surface of the second intermediate tapered-diameter portion 14B is in contact with a proximal side of the above-described plate gasket 8. The lock portion 56 is in contact with a distal side of the plate gasket 8. Thus, a space between the insulator 10 and the metal shell 50 is sealed with the plate gasket 8, as described above. The position of the plate gasket 8 in the axial direction is determined within a range RG (FIG. 2) in the axial direction corresponding to the threaded area of the outer surface of the threaded portion 52 of the metal shell 50.

The cap member 60 has a substantially annular shape having an opening 63 at a portion through which the axial line CO passes. The cap member 60 includes an outer edge portion 61 and an inner edge portion 62. The outer edge portion 61 is joined to the distal surface 50S of the metal shell 50 by, for example, resistance welding or laser welding. The inner edge portion 62 protrudes radially inward beyond the inner circumferential surface of the metal shell 50 to cover part of a distal portion of the second distal tapered-diameter portion 16B.

The ground electrode 30 is a substantially circular plate member and covers the distal side of the through hole 12B of the second member 10B. The ground electrode 30 has a communication hole 31 (hereinafter also referred to as an orifice 31) at a portion at which it crosses with the axial line CO of the ground electrode 30. The outer edge portion of the ground electrode 30 is joined to the radially inner edge of the inner edge portion 62 of the cap member 60 by, for example, laser welding. Since the ground electrode 30 has the orifice 31, the ground electrode 30 is also referred to as an orifice electrode.

A distal portion of the long leg portion 13A, a distal portion of the second member 10B, the surface of the central electrode 20, and the inner surface (proximal surface) of the ground electrode 30 define a cavity CV. Specifically, for example, the outer circumferential surfaces of the first intermediate tapered-diameter portion 132A, the first distal uniform-diameter portion 133A, and the first distal tapered-diameter portion 134A define part of the cavity CV. In addition, for example, the inner circumferential surfaces of the second proximal uniform-diameter portion 13B, the second intermediate tapered-diameter portion 14B, the second distal uniform-diameter portion 15B, and the second distal tapered-diameter portion 16B define part of the cavity CV. The discharge surface 26S of the central electrode 20 also defines part of the cavity CV. The spark gap between the discharge surface 26S and the ground electrode 30 is located inside the cavity CV.

Figure 3:
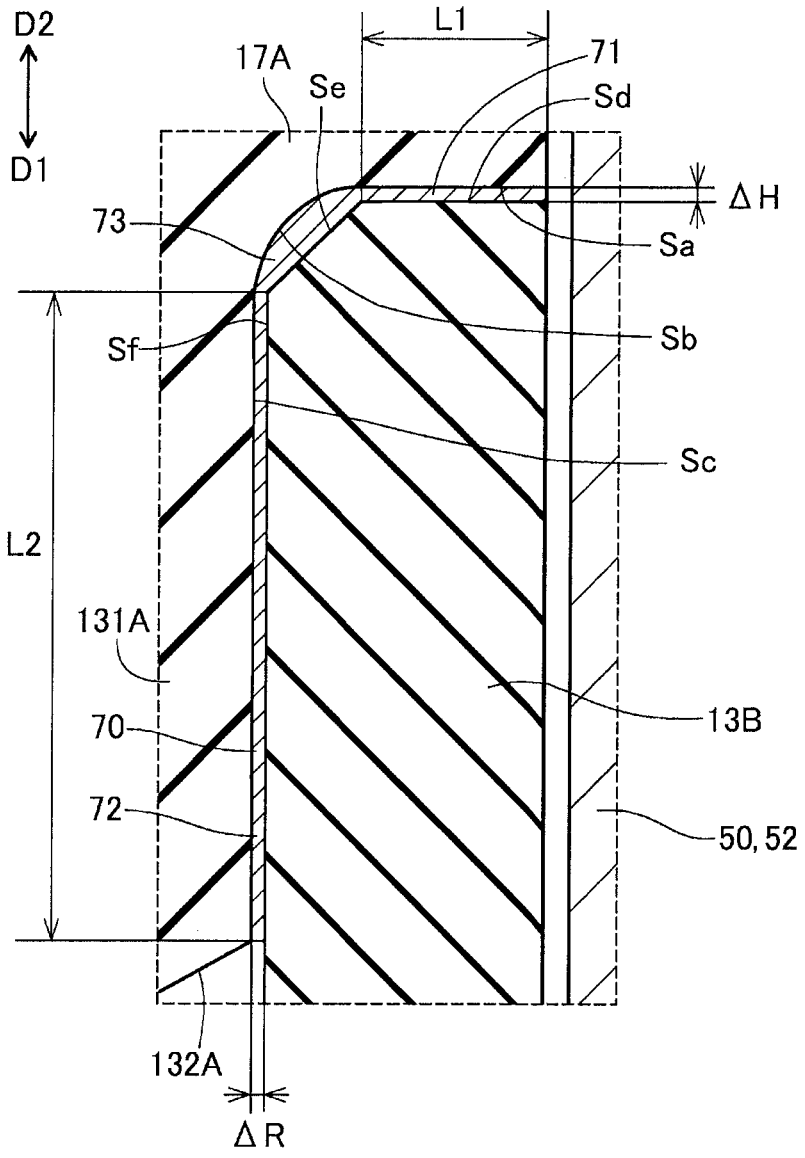
FIG. 3 is an enlarged view of a portion III enclosed by the broken line in FIG. 2.

FIG. 3 is an enlarged view of a portion III enclosed by the broken line of FIG. 2. The first member 10A and the second member 10B of the insulator 10 are joined together with the inorganic seal layer 70 interposed therebetween. The inorganic seal layer 70 is made of, for example, $B_2O_3$—$SiO_2$ glass. The softening point of glass forming the inorganic seal layer 70 is preferably higher than or equal to 900 degrees Celsius, and, in this embodiment, approximately 900 degrees Celsius. The melting point of glass forming the inorganic seal layer 70 is preferably higher than or equal to 1,200 degrees Celsius, and, in this embodiment, approximately 1,250 degrees Celsius. The melting point of glass is an idea different from the softening point and is a temperature at which glass completely melts into liquid. The melting point of glass can be also called the fusing point of crystals having the same composition as that of the glass.

The inorganic seal layer 70 includes a first seal portion 71, a second seal portion 72, and a third seal portion 73. As illustrated in FIG. 3, the first seal portion 71 seals the space between a distal surface Sa of the distal trunk portion 17A of the first member 10A and a proximal surface Sd of the second proximal uniform-diameter portion 13B of the second member 10B. A distance ΔH between the distal surface Sa of the distal trunk portion 17A and the proximal surface Sd of the second proximal uniform-diameter portion 13B is smaller than or equal to 0.2 mm. In the section in FIG. 3, the longitudinal dimension (radial dimension) of the first seal portion 71 is represented as a seal length L1 of the first seal portion 71.

The second seal portion 72 seals a space between an outer circumferential surface Sc of the first proximal uniform-diameter portion 131A of the first member 10A and an inner circumferential surface Sf of the second proximal uniform-diameter portion 13B of the second member 10B. A distance ΔR between the outer circumferential surface Sc of the first proximal uniform-diameter portion 131A and the inner circumferential surface Sf of the second proximal uniform-diameter portion 13B is smaller than or equal to 0.2 mm. In the section in FIG. 3, the longitudinal dimension (axial length) of the second seal portion 72 is represented as a seal length L2 of the second seal portion 72.

The third seal portion 73 seals a space between an outer surface Sb of the first member 10A and an inner surface Se of the second member 10B. The outer surface Sb is a curved surface connecting the distal surface Sa of the distal trunk portion 17A and the outer circumferential surface Sc of the first proximal uniform-diameter portion 131A. The inner surface Se is a slope connecting the proximal surface Sd of the second proximal uniform-diameter portion 13B and the inner circumferential surface Sf of the second proximal uniform-diameter portion 13B. The inner surface Se is a surface chamfered to prevent the first member 10A and the second member 10B from interfering with each other and cracking during assembly. The distance between the outer surface Sb and the inner surface Se is thus partially greater than 0.2 mm.

In the section in FIG. 3, the sum of the seal length L1 of the first seal portion 71 and the seal length L2 of the second seal portion 72 (L1 +L2) is greater than or equal to 1.5 mm. The section in FIG. 2 is linearly symmetrical with respect to the axial line CO. As in the case of the right side of the axial line CO (in FIG. 3), the first seal portion 71 has the seal length L1 and the second seal portion 72 has the seal length L2 also on the left side of the axial line CO. The sum of the seal lengths (2×(L1+L2)) of portions of the gap between the first member 10A and the second member 10B that are sealed by the inorganic seal layer 70 and that have a distance smaller than or equal to 0.2 mm is thus greater than or equal to 3 mm in the section in FIG. 2, in this embodiment.

A-3. Operation of Plasma Jet Plug 100

Figure 4:
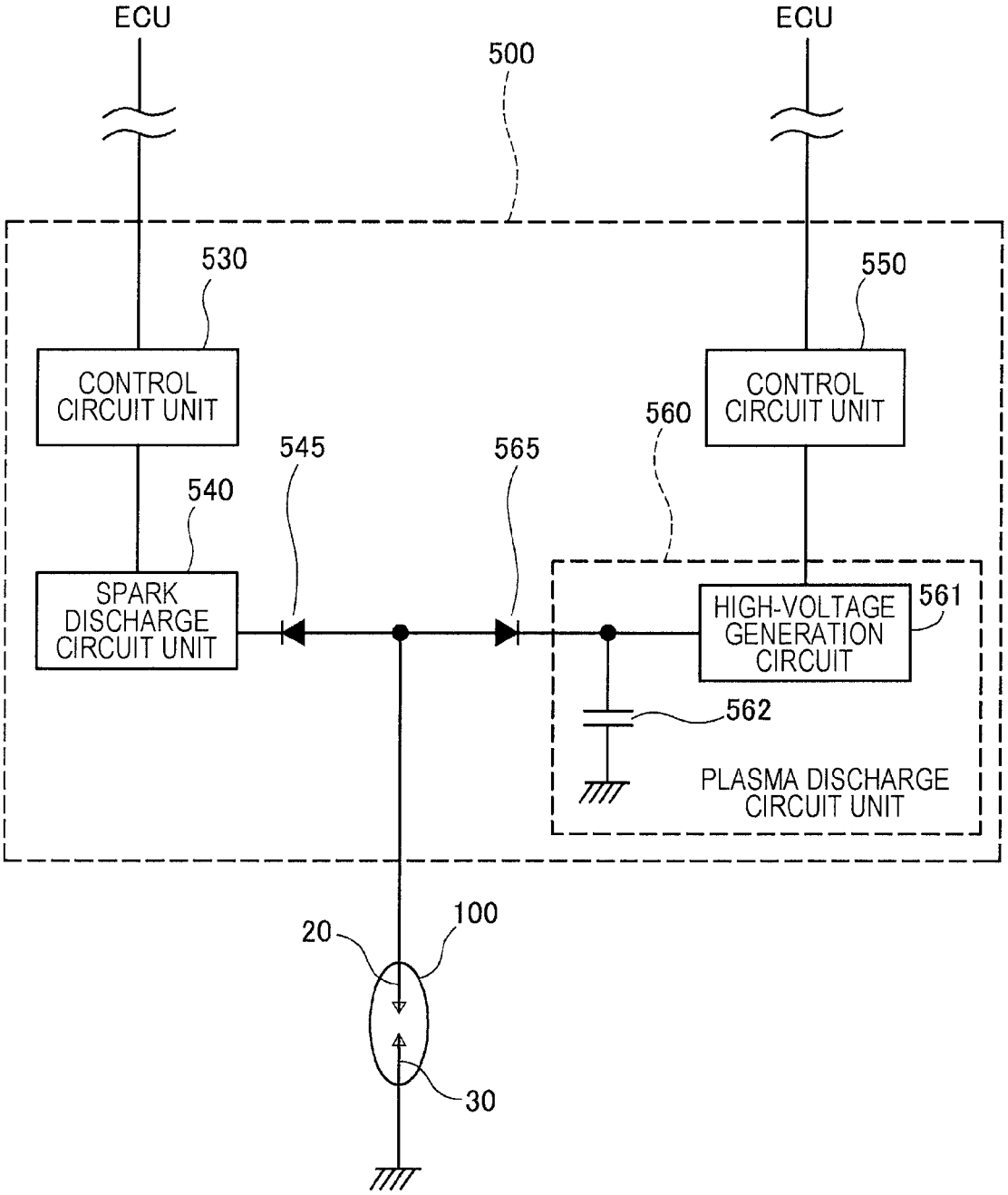
FIG. 4 is a block diagram of a schematic configuration of an ignition system 120.

FIG. 4 is a block diagram of a schematic configuration of an ignition system 500. The plasma jet plug 100 is connected to the ignition system 500, illustrated in FIG. 4 as an example. The plasma jet plug 100 is fed with power by the ignition system 500 to ignite the air-fuel mixture in the combustion chamber of an internal combustion engine.

The ignition system 500 feeds power to the plasma jet plug 100 in response to a command from, for example, an electronic control circuit (ECU) of an automobile. The ignition system 500 includes a spark discharge circuit unit 540, a plasma discharge circuit unit 560, control circuit units 530 and 550, and two diodes 545 and 565 for backflow prevention.

The spark discharge circuit unit 540 is a power supply circuit that causes a spark discharge, that is, a triggered discharge as a result of causing dielectric breakdown in response to an application of a high voltage in the spark gap between the central electrode 20 and the ground electrode 30 of the plasma jet plug 100. The spark discharge circuit unit 540 is controlled by the control circuit unit 530 connected to an ECU. The spark discharge circuit unit 540 is electrically connected to the central electrode 20 of the plasma jet plug 100, to which the spark discharge circuit unit 540 feeds power, with the diode 545 interposed therebetween.

The plasma discharge circuit unit 560 is a power supply circuit that feeds high energy to the spark gap subjected to the dielectric breakdown using the triggered discharge caused by the spark discharge circuit unit 540. The plasma discharge circuit unit 560 is controlled by the control circuit unit 550 connected to an ECU, as in the case of the spark discharge circuit unit 540. The plasma discharge circuit unit 560 is also connected to the central electrode 20 of the plasma jet plug 100 with the diode 565 for backflow prevention interposed therebetween. The ground electrode 30 of the plasma jet plug 100 is grounded with the metal shell 50 interposed therebetween.

The plasma discharge circuit unit 560 includes a capacitor 562, which stores electric energy, and a high-voltage generation circuit 561, which charges the capacitor 562 with power. The capacitor 562 is grounded at one end. The capacitor 562 is connected to the high-voltage generation circuit 561 and, with the diode 565 interposed therebetween, the central electrode 20 at the other end. Here, the amount of energy EG (at the unit of mJ) fed to the spark gap for one plasma jet is the sum of the amount of energy fed by a triggered discharge and the amount of energy fed by the capacitor 562. The electric capacity of the capacitor 562 is so adjusted that the amount of energy EG is regulated to a specific amount. The plasma jet plug 100 is capable of being driven even by an ignition system of a type, for example, excluding a plasma discharge circuit unit 560, that is, an ignition system of a type that only feeds energy resulting from a triggered discharge. Nevertheless, the plasma jet plug 100 is capable of producing higher energy plasma when being driven by the ignition system 500 illustrated in FIG. 4.

When a spark discharge is caused in the spark gap of the plasma jet plug 100 as a result of a feed of a high voltage from the ignition system 500, the energy of the spark discharge fed by the ignition system 500 excites gas inside the cavity CV illustrated in FIG. 2 and forms plasma in the cavity CV. The plasma formed in the cavity CV expands and thus the pressure inside the cavity CV rises. The plasma in the cavity CV is then ejected from the orifice 31 of the ground electrode 30 in a pillar form. The plasma ejected in a pillar form is also referred to as plasma. The ejected plasma ignites the air-fuel mixture inside the combustion chamber of an internal combustion engine.

A-4. Method for Manufacturing Plasma Jet Plug 100

Figure 5:
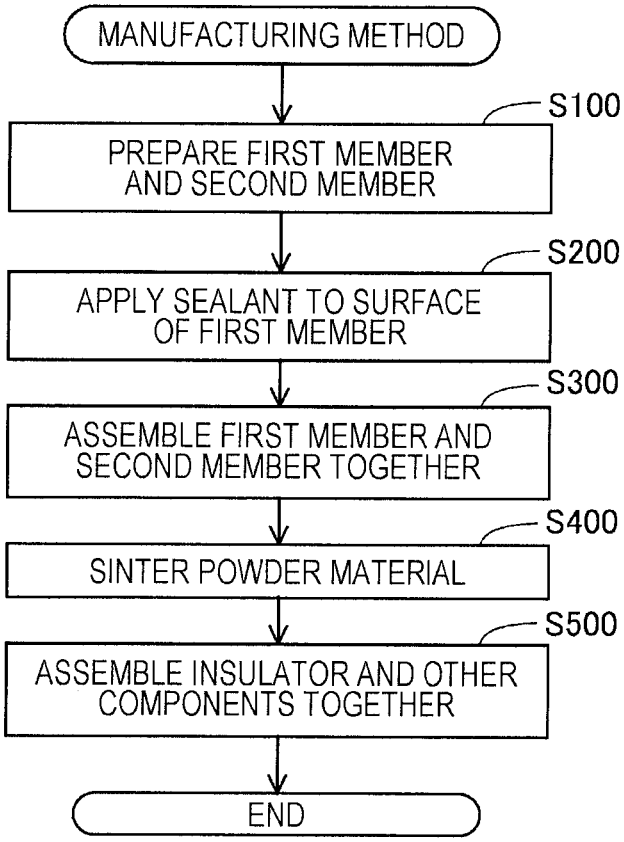
FIG. 5 is a flowchart of a process of manufacturing the plasma jet plug 100.

A method for manufacturing the plasma jet plug 100 is described now, mainly using a method for manufacturing the insulator 10. FIG. 5 is a flowchart of a process for manufacturing the plasma jet plug 100.

In S100, the first member 10A and the second member 10B are individually prepared. The first member 10A and the second member 10B are separately manufactured by a typical method for manufacturing insulators. For example, a compact is manufactured by pressing and shaping, for example, a powder material containing alumina and a sintering additive using a die set. The compact is ground to have a specific shape and the ground compact is sintered in a sintering furnace. In this manner, the first member 10A and the second member 10B are separately manufactured.

In S200, a sealant is applied to the surface of the first member 10A. Specifically, a sealant is applied to the outer circumferential surface Sc (FIG. 3) of the first proximal uniform-diameter portion 131A of the long leg portion 13A, the distal surface Sa (FIG. 3) of the distal trunk portion 17A, and the outer surface Sb (FIG. 3) connecting the surfaces Sc and Sa. The sealant is a slurry containing a liquid (such as water) and an inorganic powder material (glass powder in this embodiment) serving as a material of the inorganic seal layer 70.

In S300, the first member 10A and the second member 10B are assembled together. Specifically, the long leg portion 13A of the first member 10A is inserted into a proximal portion of the through hole 12B of the second member 10B to form the insulator 10.

In S400, the insulator 10 is heated at a sintering furnace to remove the moisture in the slurry and to sinter the powder material in the slurry, so that the inorganic seal layer 70 is formed. The heating temperature in the sintering furnace is within a range of 1,250 degrees Celsius to 1,350 degrees Celsius, such as, 1,300 degrees Celsius.

In S500, the insulator 10 in which the inorganic seal layer 70 has been formed and other components are assembled into the plasma jet plug 100.

Specifically, the central electrode 20 is placed in the axial hole 12A of the insulator 10. A portion of the axial hole 12A located at the proximal end side of the central electrode 20 is filled with the powder material of the electrically conductive seal 4. The metal terminal 40 is inserted, in the axial direction, into a distal opening of the axial hole 12A of the insulator 10 in the state of being heated to a predetermined heating temperature. Thus, the powder material inside the axial hole 12A of the insulator 10 is softened and sintered to form the electrically conductive seal 4 and, concurrently, the metal terminal 40 is assembled. The powder material of the electrically conductive seal 4 is a mixture of powder of metal (such as Cu—Zn alloy) and powder of glass (specifically, for example, $B_2O_3$—$SiO_2$ glass) having a lower softening point than glass of a powder material of the inorganic seal layer 70. The predetermined heating temperature is higher than the softening point of the glass of the powder material of the electrically conductive seal 4 and lower than the softening point of the glass of the powder material of the inorganic seal layer 70 (for example, 800 degrees Celsius). Thus, during forming of the electrically conductive seal 4, the inorganic seal layer 70 is prevented from being softened and the joint between the first member 10A and the second member 10B of the insulator 10 is prevented from becoming loose.

The insulator 10 is then installed in the metal shell 50. The cap member 60 and the ground electrode 30 are joined to the distal end of the metal shell 50, so that the plasma jet plug 100 is complete.

In the plasma jet plug 100 according to this embodiment described thus far, the insulator 10 includes the first member 10A and the second member 10B, and a cavity is defined by a distal portion of the first member 10A, a distal portion of the second member 10B, a surface of the central electrode 20, and an inner surface of the ground electrode 30 (orifice electrode). The surfaces of the insulator 10 defining the cavity CV can thus have a complex shape. This complex shape can extend a path along which a spark is discharged (surface path) over the surface of the insulator 10 without excessively increasing the capacity of the cavity CV. This configuration can thus prevent an occurrence of a surface discharge without reducing the amount of plasma ejected, so that the plasma jet plug 100 can satisfy both the durability and the ignition performance.

Two types of discharge path of a spark discharge produced between the central electrode 20 and the ground electrode 30 of the plasma jet plug 100 are conceivable: an air path RT1 and a surface path RT2. As illustrated in FIG. 2, the air path RT1 is a discharge path extending in the space from the central electrode 20 to the ground electrode 30. As illustrated in FIG. 2, the surface path RT2 is a path extending over the surfaces of the insulator 10 (first member 10A and second member 10B). For example, the surface path RT2 illustrated in FIG. 2 extends from the side surface of the discharge portion 26 to the ground electrode 30, through the outer circumferential surfaces of the first distal tapered-diameter portion 134A, the first distal uniform-diameter portion 133A, and the first intermediate tapered-diameter portion 132A, and the inner circumferential surfaces of the second distal uniform-diameter portion 15B and the second distal tapered-diameter portion 16B.

A spark discharge that passes along only the air path is also referred to as an air discharge. A spark discharge that passes along a path including a surface path is also referred to as a surface discharge. An air discharge is more desirable than the surface discharge because an occurrence of a surface discharge may damage the insulator 10 due to spark energy. For example, the surface discharge may produce a scratch or a groove called channeling on the insulator 10. Such damage may impair the durability of the plasma jet plug 100.

Moreover, if the amount of plasma ejected from the orifice 31 decreases, the energy for igniting the air-fuel mixture inside the combustion chamber is reduced, so that the ignition performance of the plasma jet plug 100 decreases. The decrease of the amount of plasma ejected is caused when, for example, the cavity CV has an excessively large capacity.

It is difficult, for example, to form a distal portion of the insulator 10 having the first distal uniform-diameter portion 133A and the first distal tapered-diameter portion 134A at a portion radially inward of the second distal uniform-diameter portion 15B with only a single component without joining two components. Ceramics forming an insulator usually have lower ductility and higher brittleness than, for example, metal such as iron. Thus, ceramics forming an insulator are less easily processible plastically or by machining than, for example, metal such as iron. The insulator 10 according to the embodiment is manufactured by joining the first member 10A and the second member 10B, which are separately manufactured, together. Thus, the distal portion of the insulator 10 that defines part of the cavity CV can have a complex shape.

Since the cavity CV can have a complex shape in this embodiment, the surface path RT2 can have a longer path length without increasing the capacity of the cavity CV than in the case where the cavity CV has a simple shape. Thus, the plasma jet plug 100 can prevent an occurrence of a surface discharge and satisfy both the durability and the ignition performance without reducing the amount of plasma ejected.

In this embodiment, the second member 10B is in contact with the metal shell 50 with the plate gasket 8 interposed therebetween and a gap between the first member 10A and the second member 10B is sealed by the inorganic seal layer 70. The sum of the seal lengths of portions of the gap that are sealed by the inorganic seal layer 70 and that have a distance of smaller than or equal to 0.2 mm is greater than or equal to 3 mm. This configuration can thus prevent a high-temperature combustion gas from intruding into the gap between the first member 10A and the second member 10B and transfer the heat of the first member 10A to the metal shell 50 through the inorganic seal layer 70, the second member 10B, and the plate gasket 8. The metal shell 50 is in contact with the outer wall (such as an engine head) of the internal combustion engine having a low temperature. This configuration can thus improve the heat conductivity of the insulator 10 and prevent pre-ignition that would otherwise occur when the distal portion of the insulator 10 is excessively heated.

In this embodiment, when a spark discharge or plasma is produced in the cavity CV, a portion of the first member 10A near the distal end (distal end of the first distal tapered-diameter portion 134A) is heated. As indicated with arrows ΔR1 and ΔR2 in FIG. 2, the heat of the distal portion of the first member 10A is transferred to the second member 10B through the inorganic seal layer 70. Then, as indicated with arrow ΔR3 in FIG. 2, the heat that has been transferred to the second member 10B is transferred to the metal shell 50 through the plate gasket 8 made of a metal having higher thermal conductivity than that of the insulator 10. If the inorganic seal layer 70 is not disposed between the first member 10A and the second member 10B, a space or a portion having high contact resistance would be formed at a position at which the inorganic seal layer 70 is disposed in this embodiment. In this case, the thermal conductivity of a heat transfer path from the first member 10A to the second member 10B indicated with arrows AR1 and ΔR2 in FIG. 2 would decrease and the heat conductivity of the insulator 10 would thus decrease. In addition, in this case, a high-temperature combustion gas would intrude toward the proximal end along the gap between the first member 10A and the second member 10B and would be more likely to raise the temperature of the first member 10A and the second member 10B and the heat conductivity of the first member 10A and the second member 10B would thus be lowered. Moreover, if the sum of the seal lengths (2×(L1+L2)) of portions of the inorganic seal layer 70 (FIG. 3) is smaller than 3 mm, the area of the heat transfer path from the first member 10A to the second member 10B is not large enough to ensure the heat conductivity. The distal portion of the first member 10A would thus be excessively heated and pre-ignition would be more likely to occur. This embodiment, on the other hand, can avoid such inconvenience.

In addition, if the thickness of the inorganic seal layer 70, that is, a distance ΔR or ΔH (FIG. 3) between the first member 10A and the second member 10B at a portion at which the first seal portion 71 or the second seal portion 72 is disposed is larger than 0.2 mm, the heat conductivity would be lowered due to excessively high heat resistance of the first seal portion 71 or the second seal portion 72 in the thickness direction. In this embodiment, the sum of the seal lengths of portions that are sealed by the inorganic seal layer 70 and that have a distance smaller than or equal to 0.2 mm is greater than or equal to 3 mm. Thus, such an inconvenience can be avoided.

In this embodiment, the position of the plate gasket 8 in the axial direction is located within a range RG (FIG. 2) of a threaded area (threaded portion 52) of the outer circumferential surface of the metal shell 50 in the axial direction. Thus, the heat transferred from the insulator 10 to the metal shell 50 through the plate gasket 8 can be easily transferred to the outer wall (such as an engine head) of an internal combustion engine through the thread. The insulator 10 can thus have higher heat conductivity.

In this embodiment, the inorganic seal layer 70 contains glass having a melting point of higher than or equal to 1,200 degrees Celsius and a softening point of higher than or equal to 900 degrees Celsius. The softening point of the glass contained in the inorganic seal layer 70 is thus higher than the softening point of the glass contained in the electrically conductive seal 4. Thus, in the process of forming the electrically conductive seal 4 during manufacture of the plasma jet plug 100, the inorganic seal layer 70 is prevented from being softened and the joint between the first member 10A and the second member 10B is prevented from becoming loose. Also in the case where the plasma jet plug 100 is exposed to a high temperature (such as 800 degrees Celsius) during an operation of an internal combustion engine, the inorganic seal layer 70 is prevented from being softened and the joint between the first member 10A and the second member 10B is prevented from becoming loose.

A method for manufacturing the plasma jet plug 100 according to the embodiment also includes a step (S200 in FIG. 5) of applying slurry containing an inorganic powder material to the surface of the first member 10A including the outer surface of the long leg portion 13A, a step (S300 in FIG. 5) of inserting the long leg portion 13A into the through hole 12B of the second member 10B to form the insulator 10, and a step (S400 in FIG. 5) of sintering the powder material as a result of heating the insulator 10 to a temperature within a range of 1,250 degrees Celsius to 1,350 degrees Celsius to form the inorganic seal layer 70 that seals a gap between the first member 10A and the second member 10B. This method can thus manufacture the plasma jet plug 100 including the insulator 10 including the inorganic seal layer 70, which appropriately seals a gap between the first member 10A and the second member 10B.

B. Evaluation Test

For an evaluation test, 24 types of samples were manufactured such that each of the samples has the inorganic seal layer 70 whose seal length is designed as in Table 1 and each of the samples has the first member 10A and the second member 10B spaced apart from each other by a distance designed as in Table 1. As illustrated in FIG. 3, the seal length of the inorganic seal layer 70 is the sum of the seal lengths of the first seal portion 71 and the second seal portion 72 (2×(L1+L2)). As illustrated in FIG. 3, the distance between the first member 10A and the second member 10B is either a distance ΔH or distance ΔR between the first member 10A and the second member 10B at a portion at which the first seal portion 71 or the second seal portion 72 is disposed.

The samples have the following points in common:

alumina is used as a material of the first member 10A and the second member 10B;

glass containing 30 percent by weight of $SiO_2$, 20 percent by weight of $B_2O_3$, and 15 percent by weight of ZnO (the remnants include impurities and a binder) is used as a material of the inorganic seal layer 70;

the screw diameter of the metal shell 50 is M12;

the inner diameter of the cavity (inner diameter of the through hole 12B of the second member 10B) is 5 mm; and the outer diameter of the discharge portion 26 of the central electrode 20 is 1.5 mm.

TABLE 1

| | | Seal Length (mm) | | | |
|---|---|---|---|---|---|
| | | 1 | 2 | 3 | 4 |
| Distance (mm) | 0.05 | B | B | A | A |
| | 0.1 | B | B | A | A |
| | 0.15 | B | B | A | A |
| | 0.2 | B | B | A | A |
| | 0.21 | B | B | B | B |
| | 0.25 | B | B | B | B |

The seal length (2×(L1+L2)) of the inorganic seal layer 70 was selected from 1 mm, 2 mm, 3 mm, and 4 mm. The seal length of the inorganic seal layer 70 was adjusted by changing the seal length L2 of the second seal portion 72 while keeping the seal length L1 of the first seal portion 71 in FIG. 3 unchanged. The seal length L2 of the second seal portion 72 was changed by changing the axial length of the first proximal uniform-diameter portion 131A of the first member 10A and by changing the axial length of the second proximal uniform-diameter portion 13B of the second member 10B.

Each of the distances ΔH and ΔR between the first member 10A and the second member 10B was selected from 0.05 mm, 0.1 mm, 0.15 mm, 0.2 mm, 0.21 mm, and 0.25 mm. A sample having a distance of 0.02 mm, which is smaller than 0.05 mm, was failed to be formed due to an insufficiently small distance. Each of the distances ΔH and ΔR between the first member 10A and the second member 10B was adjusted by changing the outer diameter of the first proximal uniform-diameter portion 131A of the first member 10A and the amount of applied slurry of the powder material of the inorganic seal layer 70 while keeping the inner diameter of the second proximal uniform-diameter portion 13B of the second member 10B unchanged.

Each sample was subjected to an evaluation test to check the resistance to pre-ignition (hereinafter also referred to as pre-ignition resistance), as illustrated below. Each type of sample was operated in an actual device for two minutes. In the operation in an actual device, each sample was installed in a four-cylinder, 1.3-liter, naturally aspirated gasoline engine and operated at full throttle (or wide-open throttle (WOT)) at a rotation speed of 6,000 rpm. During the operation, each sample was fed with discharge energy of 50 mJ for each spark discharge using a predetermined power supply device (for example, a fully transistorized ignition system). The gasoline engine is designed to be operated at the ignition timing advanced by 20 degrees (the ignition timing advanced by 20 degrees from the top dead center). In this test, the sample was operated at the ignition timing advanced by 40 degrees to facilitate an occurrence of pre-ignition.

A sample that did not cause pre-ignition during operation was evaluated as "A", and a sample that caused pre-ignition during operation was evaluated as "B". The evaluation results are shown in Table 1.

Samples in each of which the inorganic seal layer 70 has a seal length smaller than 3 mm, that is, six types of sample in each of which the inorganic seal layer 70 has a seal length of 2 mm and six types of sample in each of which the inorganic seal layer 70 has a seal length of 1 mm were all evaluated as "B" regardless of the distances ΔH and ΔR between the first member 10A and the second member 10B.

Samples in each of which the distances ΔH and ΔR between the first member 10A and the second member 10B are greater than 0.2 mm, that is, four types of sample in each of which the distances ΔH and ΔR are greater than 0.21 mm and four types of sample in each of which the distances ΔH and ΔR are 0.25 mm were all evaluated as "B" regardless of the seal length of the inorganic seal layer 70.

On the other hand, samples in each of which the inorganic seal layer 70 has a seal length of greater than or equal to 3 mm and the distances ΔH and ΔR between the first member 10A and the second member 10B are smaller than or equal to 0.2 mm were all evaluated as "A". Specifically, eight types of samples in each of which the inorganic seal layer 70 has a seal length of 3 mm or 4 mm and the distances ΔH and ΔR are 0.05 mm, 0.1 mm, 0.15 mm, or 0.2 mm were all evaluated as "A".

The above-described evaluation results have revealed that the insulator 10 has higher heat conductivity and higher pre-ignition resistance provided that the sum of the seal lengths of portions of the gap, in a section including the axial line CO illustrated in FIG. 2 and FIG. 3, between the first member 10A and the second member 10B that are sealed by the inorganic seal layer 70 and that have a distance of smaller than or equal to 0.2 mm is greater than or equal to 3 mm.

Figure 6A:
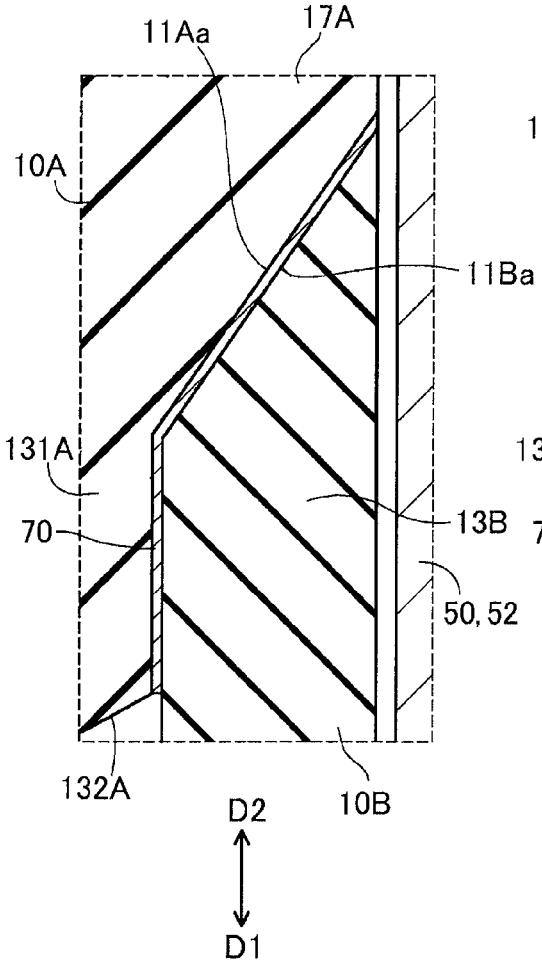
FIGS. 6A and 6B are inorganic seal layers 70 according to modification examples.
Figure 6B:
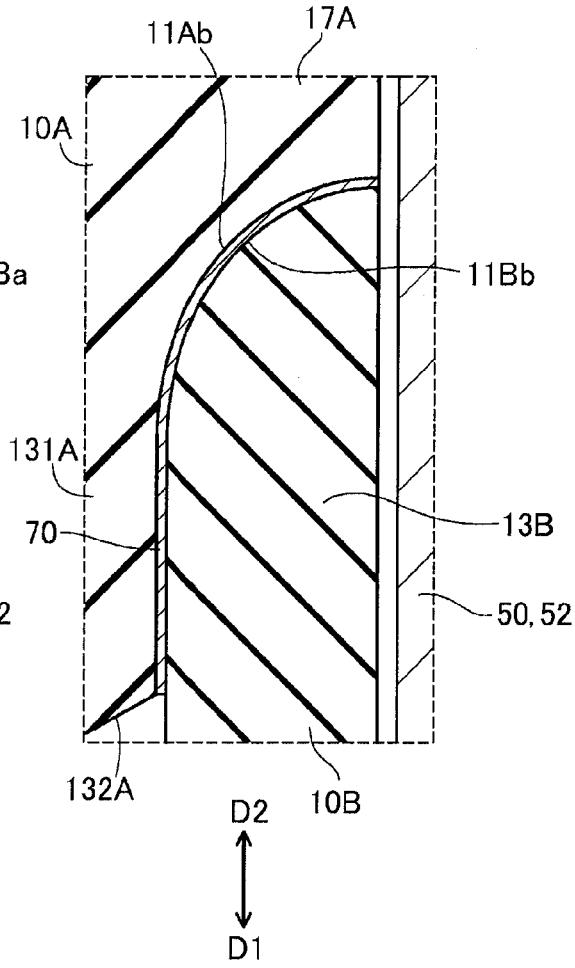

C. Modification Example (1) The shape of the inorganic seal layer 70 between the first member 10A and the second member 10B is not limited to the shape illustrated in FIG. 3 and may be modified in various manners in accordance with the shapes of the first member 10A and the second member 10B. FIGS. 6A and 6B are inorganic seal layers 70 according to modification examples.

In a modification example illustrated in FIG. 6A, a first member 10A includes a tapered outer-diameter portion 11Aa between a distal trunk portion 17A and a first proximal uniform-diameter portion 131A, the tapered outer-diameter portion 11Aa having an outer diameter that tapers from the proximal side toward the distal side. A second member 10B includes a tapered inner-diameter portion 11Ba at a proximal portion of the second proximal uniform-diameter portion 13B, the tapered inner-diameter portion 11Ba having an inner diameter that tapers from the proximal side toward the distal side. The modification example illustrated in FIG. 6A thus has a gap between the tapered outer-diameter portion 11Aa of the first member 10A and the tapered inner-diameter portion 11Ba of the second member 10B in a section illustrated in FIG. 6A, the gap being inclined with respect to the axial line CO. A proximal portion of the inorganic seal layer 70 is disposed in the gap. Thus, in the modification example illustrated in FIG. 6A, the inorganic seal layer 70 includes a distal portion extending parallel to the axial line CO and a proximal portion inclined with respect to the axial line CO. In this case, for example, preferably, the distances between the first member 10A and the second member 10B at both distal and proximal portions of the inorganic seal layer 70 are smaller than or equal to 0.2 mm and the sum of the seal lengths of the distal and proximal portions is greater than or equal to 3 mm.

In the modification example illustrated in FIG. 6A, the outer diameter of the tapered outer-diameter portion 11Aa of the first member 10A tapers linearly in the section including the axial line CO. In a modification example illustrated in FIG. 6B, on the other hand, the outer diameter of a tapered outer-diameter portion 11Ab of the first member 10A tapers so as to be curved in a convex protruding toward the proximal end. In the section including the axial line CO, the inner diameter of the tapered inner-diameter portion 11Ba of the second member 10B tapers linearly. In the modification example illustrated in FIG. 6B, on the other hand, the inner diameter of a tapered inner-diameter portion 11Bb of the second member 10B tapers so as to be curved in a convex protruding toward the proximal end. Thus, in the modification example illustrated in FIG. 6B, the inorganic seal layer 70 includes a distal portion extending parallel to the axial line CO and a proximal portion inclined with respect to the axial line CO and extending in a curve. Also in this case, for example, preferably, the distances between the first member 10A and the second member 10B at both distal and proximal portions of the inorganic seal layer 70 are smaller than or equal to 0.2 mm and the sum of the seal lengths of the distal and proximal portions is greater than or equal to 3 mm.

(2) In step S200 of the method for manufacturing the plasma jet plug 100 according to the embodiment (FIG. 5), slurry containing a powder material of the inorganic seal layer 70 is applied to the surface of the first member 10A. Additionally or instead, the slurry may be applied to the surface (inner surface) of the second member 10B. Specifically, the slurry may be applied to the proximal surface Sd (FIG. 3) of the second proximal uniform-diameter portion 13B of the second member 10B and the inner circumferential surface Sf (FIG. 3) of the second proximal uniform-diameter portion 13B.

(3) In the above-described embodiment, the inorganic seal layer 70 is made of $B_2O_3$—$SiO_2$ glass. This is not the only possible configuration and the inorganic seal layer 70 may be made of any of other inorganic materials. For example, the inorganic seal layer 70 may be made of glass containing silica and alumina, an inorganic material different from glass, such as an inorganic polymer, or a mixture of such glass and the inorganic material different from the glass. The inorganic seal layer 70 may contain metal powder to, for example, enhance the thermal conductivity.

(4) Instead of the configuration of the embodiment, a firing end of the plasma jet plug 100 may have any of other configurations. For example, the ground electrode 30 may have multiple orifices 31. A tip made of Ir, Pt, W, or an alloy mainly composed of Ir, Pt, and/or W may be joined to the distal end of the discharge portion 26 of the central electrode 20.

Thus far, the present invention has been described on the basis of an embodiment and modification examples. However, the embodiment and the modification examples of the present invention are provided for easy understanding of the present invention and not intended to limit the invention. The present invention can be modified or improved without departing from the gist and the scope of claims of the invention and the present invention includes equivalents of the modification or improvement.

What is claimed is:

1. A plasma jet plug comprising:

a rod-shaped central electrode extending in a direction of an axis;

a tube-shaped insulator extending in the direction of the axis and having an axial hole in a distal portion of which the central electrode is disposed;

a metal shell disposed on an outer periphery of the insulator;

an orifice electrode electrically connected to the metal shell and located at a distal end side of the insulator; and a gasket that is in contact with an outer surface of the insulator and an inner surface of the metal shell, wherein the insulator includes;

a first member having the axial hole and including a large-diameter portion and a small-diameter portion having a smaller outer diameter than that of the large-diameter portion, the small-diameter portion being located at a distal end side of the large-diameter portion, a second member extending in the direction of the axis and having a through hole into a proximal portion of which the small-diameter portion is inserted, the second member having an outer surface that is in contact with the gasket, and an inorganic seal layer that seals a gap between the first member and the second member, the gap including a space between an outer circumferential surface of the small-diameter portion and an inner circumferential surface of the through hole, wherein a distal portion of the first member, a distal portion of the second member, a surface of the central electrode, and an inner surface of the orifice electrode define a cavity, and wherein, in a section including the axis, the sum of seal lengths of portions of the gap between the first member and the second member, which are sealed by the inorganic seal layer and have a distance of smaller than or equal to 0.2 mm, is greater than or equal to 3 mm.

2. The plasma jet plug according to claim 1, wherein a position of the gasket in the direction of the axis is located within a range of a threaded area of an outer surface of the metal shell in the direction of the axis.

3. The plasma jet plug according to claim 1, wherein the inorganic seal layer contains glass having a melting point of higher than or equal to 1,200 degrees Celsius and a softening point of higher than or equal to 900 degrees Celsius.

* * * * *